US007326000B2

(12) United States Patent
Lee

(10) Patent No.: US 7,326,000 B2
(45) Date of Patent: Feb. 5, 2008

(54) BLOCK FOR EMBANKMENT

(76) Inventor: Kang-San Lee, 490-1Simgok 2-Dong, Wonmi-Gu, Buchun-Si, Kyungki-Do, 420-829 (KR)

( * ) Notice: Subject to any disclaimer, the term of this patent is extended or adjusted under 35 U.S.C. 154(b) by 0 days.

(21) Appl. No.: 10/552,783

(22) PCT Filed: Mar. 29, 2004

(86) PCT No.: PCT/KR2004/000709

§ 371 (c)(1),
(2), (4) Date: Sep. 26, 2005

(87) PCT Pub. No.: WO2004/088047

PCT Pub. Date: Oct. 14, 2004

(65) Prior Publication Data

US 2006/0193694 A1 Aug. 31, 2006

(30) Foreign Application Priority Data

Apr. 1, 2003 (KR) ..... 10-2003-0020456

(51) Int. Cl.
*E02B 3/12* (2006.01)
*E02B 3/14* (2006.01)

(52) U.S. Cl. ..... 405/16; 405/29; 405/30

(58) Field of Classification Search ..... 405/16, 405/19, 20, 21, 29, 30
See application file for complete search history.

(56) References Cited

U.S. PATENT DOCUMENTS

| | | | | | |
|---|---|---|---|---|---|
| 3,168 | A | * | 7/1843 | Terry | 404/41 |
| 16,757 | A | * | 3/1857 | Shepard | 404/41 |
| 986,395 | A | * | 3/1911 | King | 47/33 |
| 3,137,095 | A | * | 6/1964 | Pearson | 47/83 |
| 3,310,906 | A | * | 3/1967 | Glukes | 446/95 |
| 3,438,312 | A | * | 4/1969 | Becker et al. | 404/40 |
| 3,597,928 | A | * | 8/1971 | Pilaar | 405/20 |
| 4,008,548 | A | * | 2/1977 | Leclerc | 52/180 |
| 4,372,705 | A | * | 2/1983 | Atkinson | 405/19 |
| 4,596,731 | A | * | 6/1986 | Cudmore et al. | 428/134 |
| 4,984,384 | A | * | 1/1991 | Kaufmann | 47/9 |
| 5,167,843 | A | * | 12/1992 | Guillory | 249/83 |
| D339,779 | S | * | 9/1993 | Spica | D12/221 |
| 5,250,340 | A | * | 10/1993 | Bohnhoff | 428/99 |
| 5,406,745 | A | * | 4/1995 | Lin | 47/1.01 F |
| 5,628,160 | A | * | 5/1997 | Kung | 52/591.1 |
| 5,988,942 | A | * | 11/1999 | Atkinson | 405/20 |
| 6,158,922 | A | * | 12/2000 | Fernandez | 405/21 |

FOREIGN PATENT DOCUMENTS

| | | |
|---|---|---|
| GB | 2183704 | 6/1987 |
| JP | 08-003962 | 1/1996 |
| JP | 2003-027446 | 1/2003 |
| KR | 20-0262840 | 1/2002 |

* cited by examiner

*Primary Examiner*—Tara L. Mayo
(74) *Attorney, Agent, or Firm*—IPLA P.A.; James E. Bame

(57) ABSTRACT

The present invention relates to an embankment block. There are provided a base frame 30 having a center with a through hole, and a plurality of connection members 32 that are downwardly extended from an outer surface of a rim of the base frame 30 wherein a front end of the same has an outwardly bent connection part 38. A plurality of through holes 34 are formed in a rim of the base frame 30 wherein said through holes 34 vertically pass through by the partition plate 36. The connection member 32 is widened in an outer direction of the rim of the base frame 30 and is slanted at a certain slope.

6 Claims, 6 Drawing Sheets

BLOCK FOR EMBANKMENT

TECHNICAL FIELD

The present invention relates to a block for embankment, and in particular to an embankment block that has a simple structure and is easily fabricated, and a handling and construction of the same are easy, and embankment blocks may be connected in various methods, so that the embankment blocks are well adapted to an embankment and slanted surface.

BACKGROUND ART

Generally, an embankment block is used for preventing a destruction of a bank or slanted surface of river and helps plants grow well.

In the existing Korean patent invented by the same inventor as the present invention concerning the embankment block, as shown in FIG. 1, presents a block for embankment 24 that has a base frame 16 that has a rim part 10, and a horizontal part 12 and a vertical part 14 that cross in the rim part 10 each other, a connection member 20 extended from a lower surface of the rim part 10 and having a connection part 18 in a front end of the same, and a support protrusion part 22 perpendicularly extending from a crossing point of the horizontal part 12 and the vertical part 14.

In the above conventional embankment block, a space filled with soil is formed between the upper and lower body parts in such a manner that the upper, lower, left and right sides communicate each other, and the soil filled into the space is combined and becomes one lump, so that the block is buried in integration with soil. Therefore, it is possible to achieve a hard and stable burying state of blocks. Even when time is passed long time, it is possible to prevent a phenomenon that soil and sand are missed and destroyed.

In particular, since the spaces filled with soil communicate in the upper, lower, left and right sides, the stem or roots of plants spread well through the space in the upper and lower directions as well as left and right directions for thereby growing well naturally. Therefore, the buried state of the blocks becomes more stable by the stems and roots of plants.

In addition, water plants capable of purifying water may be planted in the portion submerged under water for thereby effectively purifying water. Since the blocks are formed of waste plastic, the resource can be saved, and a low cost and economical construction are achieved.

However, the conventional embankment blocks have complicated structure and heavy, so that it is impossible to fabricate, move and engage the blocks. Therefore, it has problems that can cause the increase of the fabrication cost, and the decrease of work efficiency.

DISCLOSURE OF INVENTION

Accordingly, it is an object of the present invention to provide an embankment block capable of overcoming the problems encountered in the conventional art.

It is another object of the present invention to provide an embankment block that is capable of achieving a simple and light structure and an easier fabrication, transfer and engaging work.

To achieve the above objects, this block for embankment includes the base frame wherein the center can pass through upper and lower sides; and plurality of connection members that are downwardly extended from the outer surface of this base frame and has a connection part of which a front portion is outwardly bent in.

In the embankment block according to the present invention, the rim of the base frame includes plurality of through holes in the partition plate penetrating up and down.

In the embankment block according to the present invention, the connection member is slanted getting wider to the outer direction of the base frame's rim.

In the embankment block according to the present invention, in the inner side of the connection part a reinforcing rib is formed in the in a longitudinal direction.

In the embankment block according to the present invention, the connection part has a connection hole to connect the corresponding embankment block.

In the embankment block according to the present invention, the front portion of the connection part has a narrow width and in the back portion has a guide part leading the front portion of the connection part so that it can be overlapped with the corresponding connection part of the embankment block.

In the embankment block according to the present invention, from the plurality of the connection members, in one of the lower side of the connection part forms an engaging protrusion and in the other lower side of the connection part forms an engaging hole that the corresponding engaging protrusion of the other embankment block can be inserted.

BRIEF DESCRIPTION OF DRAWINGS

The present invention will become better understood with reference to the accompanying drawings which are given only by way of illustration and thus are not limitative of the present invention, wherein.

BEST MODE FOR CARRYING OUT THE INVENTION

The preferred embodiments of the present invention will be described with reference to the accompanying drawings.

Figure 1:
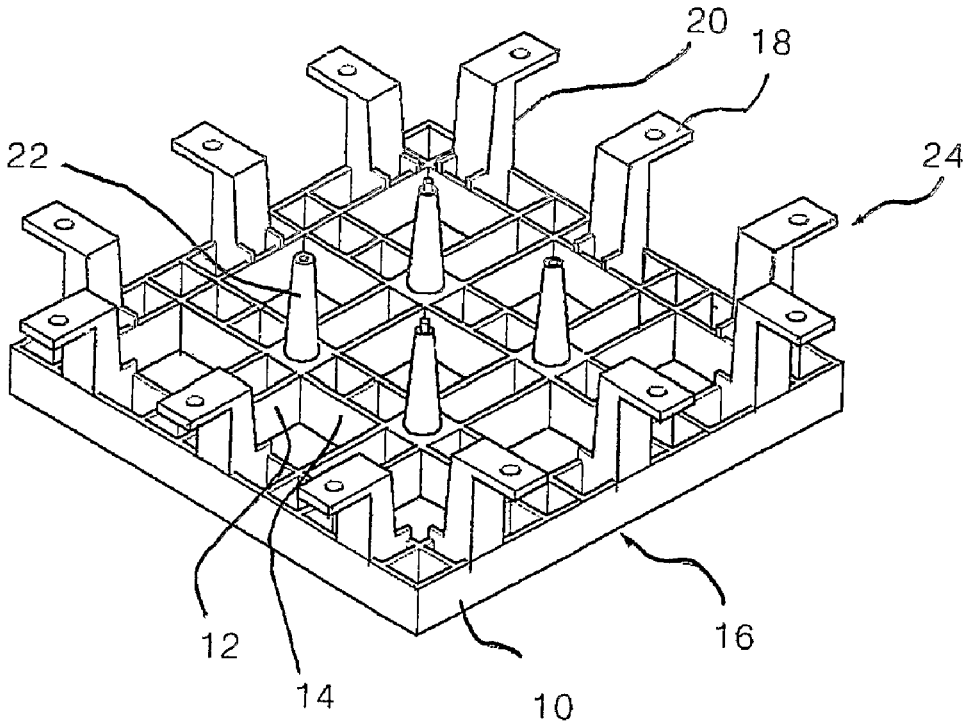
FIG. 1 is a perspective view illustrating a conventional embankment block.
Figure 2:
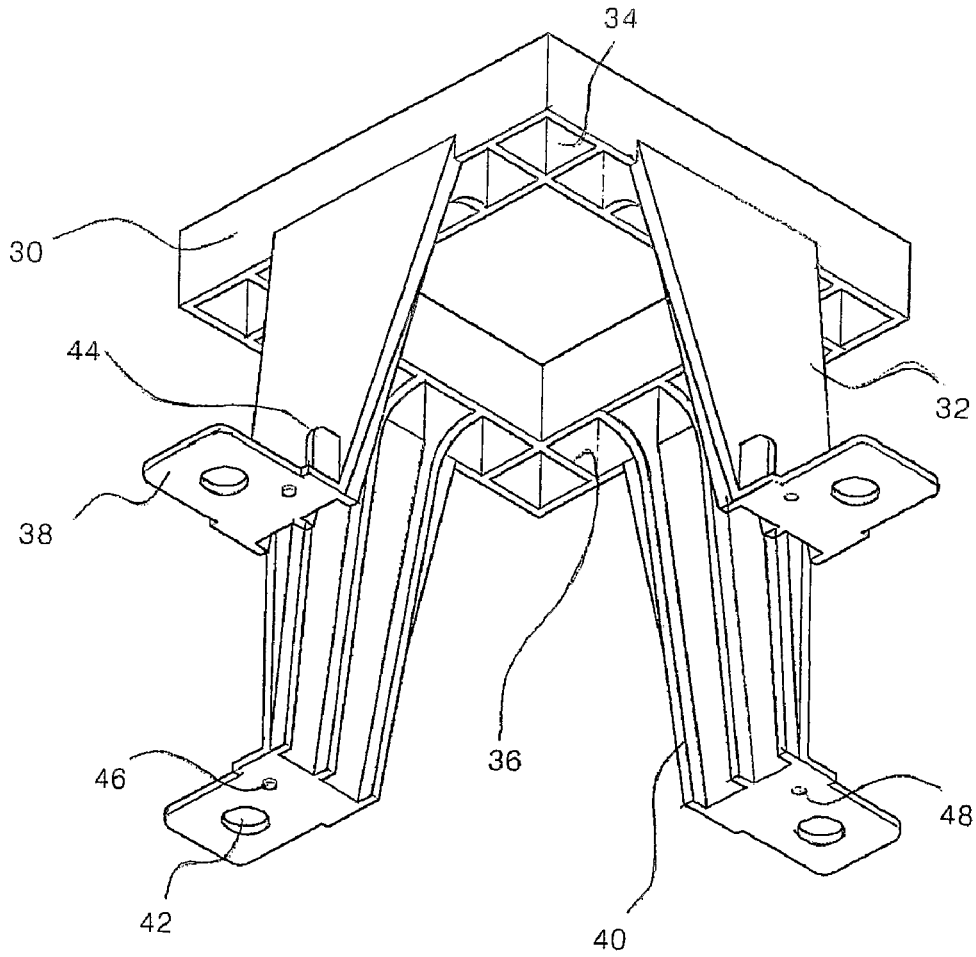
FIG. 2 is a perspective view illustrating an embankment block according to an embodiment of the present invention.

As shown in FIG. 2, the embankment block according to the present invention includes a base frame 30 having a center portion with a through hole, and a plurality of connection members 32 downwardly extended from a rim of the base frame 30.

The base frame 30 is formed of a rectangular frame shape having a certain width. The base frame 30 includes a through hole 34 formed at its center. A plurality of partition plates 36 partition the through hole 34 by a certain width.

The connection members 32 are downwardly extended from an outer surface of a rim of the base frame 30, and a connection part 38 is provided at an extended end portion wherein the connection part 38 is outwardly bent.

The connection members 32 are widened in an outer direction of the rim and are slanted at a certain slope. A plurality of reinforcing ribs 40 are formed in an inner surface of the connection member in a longitudinal direction. Here, the reinforcing ribs 40 are preferably connected with the partition plate 36 of the base frame for thereby achieving an enhanced reinforcing function with respect to the embankment blocks.

A connection hole 42 is provided in the connection part 38 of the connection member 32 for connecting the connection parts 38 each other in such a manner that the connection parts 38 of the same embankment block, in which the connection members 32 are opposite to each other, are abutted and overlapped for thereby horizontally connecting the same.

In the connection member 32, both sides of the front end of the connection part 38 are cut-away part by a certain width in such a manner that the connection parts 38 of the connected same embankment blocks are abutted with each other or are overlapped in multiple layers, so that the connection parts 38 are provided on the same height as the connection hole 42. A guide part 44 is formed at a portion in which the connection member 32 and the connection part 38 meet each other, so that the front end of the cut-away part connection part 38 is overlapped with the connection part 38 of the same embankment block.

An engaging protrusion 46 or an engaging hole 48 is formed in a lower surface of the connection part 38 of each connection member 32 for thereby being selectively engaged with the lower surface of the connection part 38 of the same embankment block. For example, in the present embodiment of the present invention, an engaging protrusion 46 is formed in the connection part 38 of one side formed about a diagonal line along four connection members 32 extended from the base frame 30, and an engaging hole 48 is formed in the connection part 38 of the other side.

Figure 3:
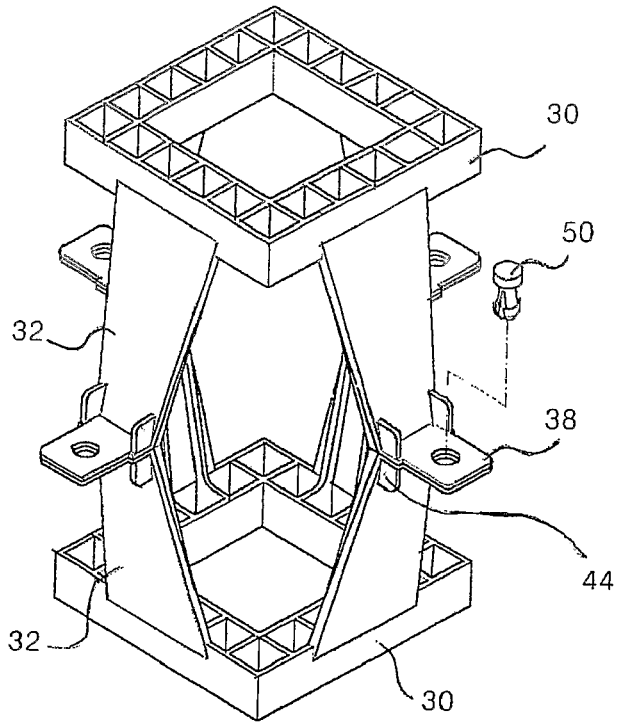
FIG. 3 is a perspective view illustrating a state of a pair of embankment block connected together according to the present invention.
Figure 4:
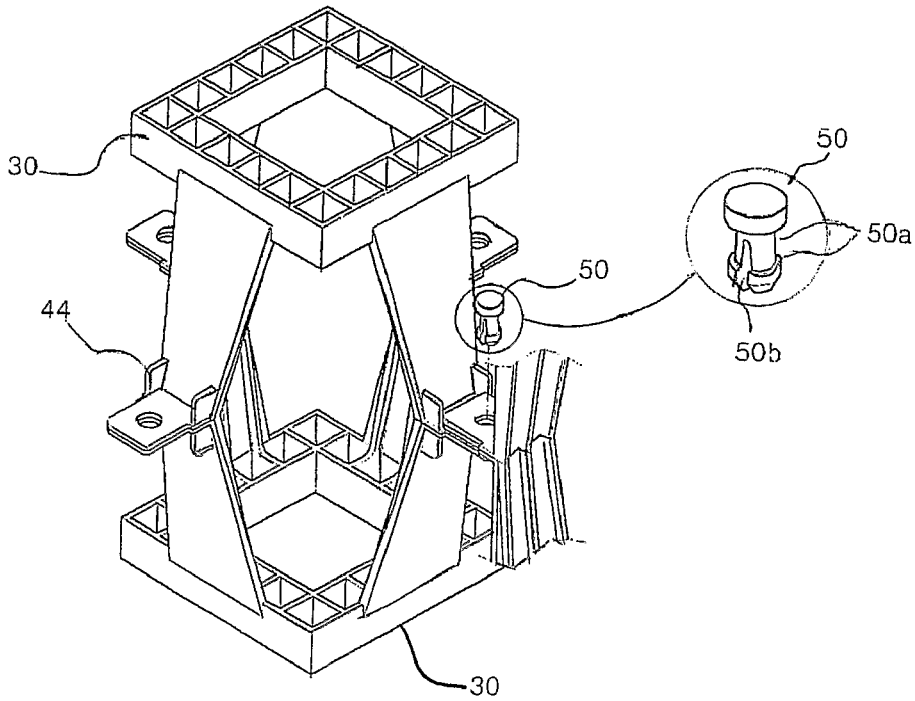
FIG. 4 is a principal perspective view illustrating a state that the connection part of the embankment block and the neighboring connection part of the embankment block overlapped in tier structure according to the present invention.

FIGS. 3 and 4 are views illustrating an example of the engagement of the embankment blocks according to the present invention. The same embankment blocks in which the connection members 32 are opposite to each other are connected using an engaging member 50 in such a manner that the connection parts 38 are abutted with each other. At this time, the engaging protrusions 46 and the engaging holes 48 of the connection parts 38 are first engaged before the embankment blocks are connected using the engaging members 50.

Here, the engaging shoulder 50*a* is formed at both ends of the engaging member 50 wherein one end of the same is caught by an outer rim part of the connection hole 42, and the other end passing through the other side is widened and caught by the outer rim part of the connection hole 42 of the other side as the corresponding connection members 32 are inserted into a pair of the connection holes 42 that are at the same height in closely contacting state. A cut-away part 50*b* elastically cut-away in a longitudinal direction is formed at the center of the other end passing through the other side.

In addition, the widened end portion of the engaging member 50 is contracted for escaping the engaging member 50 engaged to the connection hole 42 and is pushed in the reverse direction for thereby releasing the engagement.

Figure 5:
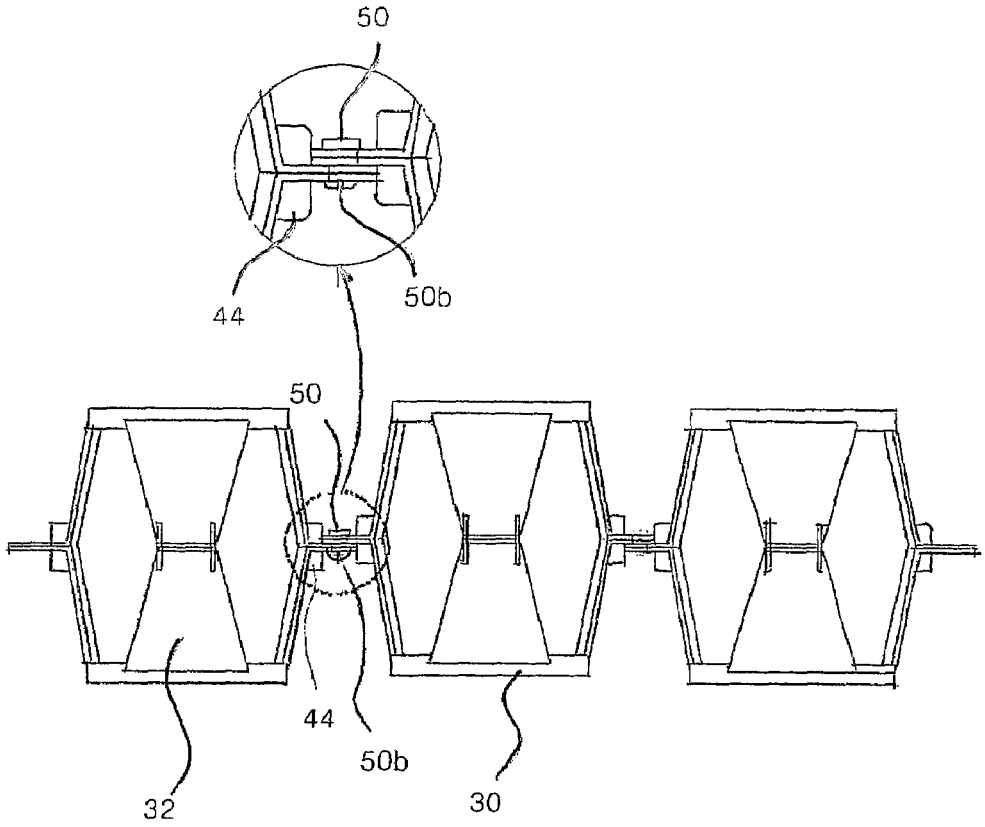
FIG. 5 is a side view illustrating a state that plurality of embankment blocks are connected in a horizontal direction according to the present invention.
Figure 6:
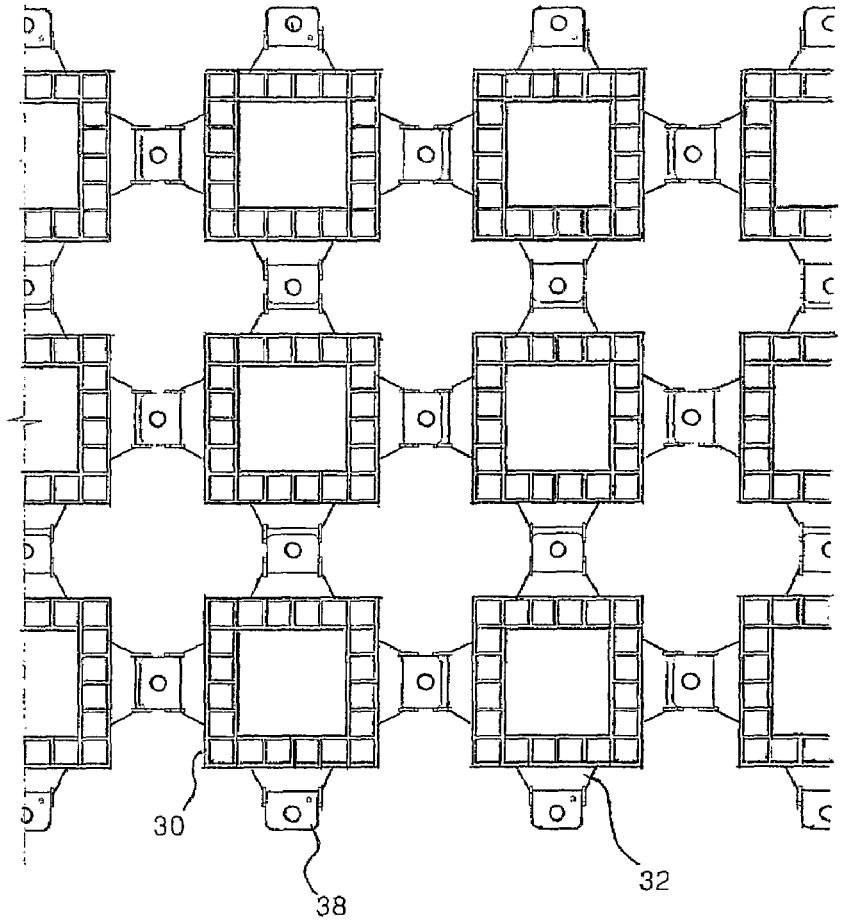
FIG. 6 is a plane figure illustrating a state that plurality of embankment blocks are connected in a horizontal direction according to the present invention.

FIGS. 5 and 6 are views illustrating another engaging example of the embankment blocks according to the present invention. The embankment blocks of FIG. 3 are connected in a horizontal direction.

Figure 7:
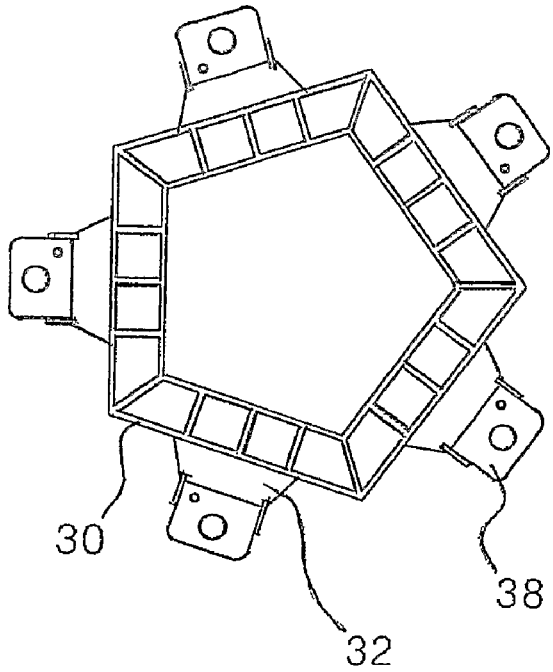
FIG. 7 is an outline plane figure illustrating an embankment block of FIG. 2 according to another embodiment of the present invention.
Figure 8:
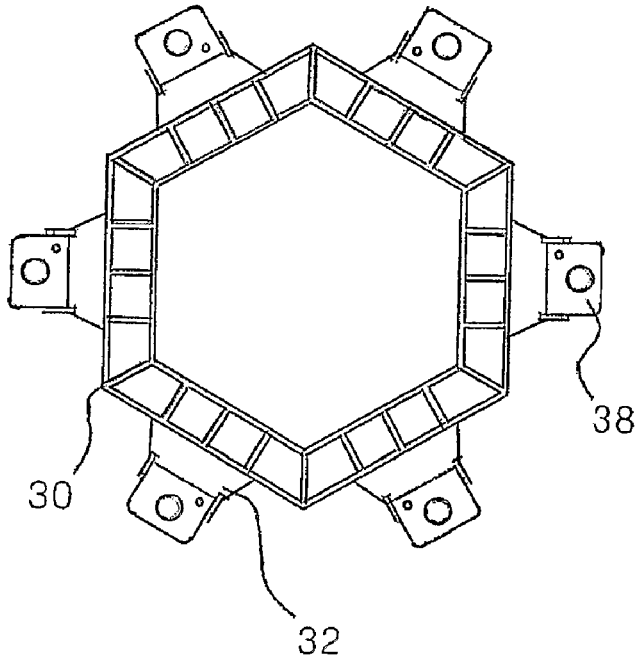
FIG. 8 is an outline plane figure illustrating another embankment block of FIG. 2 according to another embodiment of the present invention.

As shown in FIGS. 7 and 8, the base frame of the embankment block is not limited to the rectangular shape. Namely, it may be formed in a pentagonal, hexagonal or circular shape.

In the embankment blocks according to the present invention, the spaces formed in the blocks and filled with soil communicate with upper, lower, left and right sides in the same manner as the conventional embankment blocks. The soil is filled therein and is combined with other soil for thereby forming one lump, so that the embankment blocks are buried in a state that blocks and soil are integral with each other. Therefore, the buried state of the blocks is hard and stable. The soil is not lost and destroyed after a long time period. In particular, the spaces filled with soil communicate with upper, lower, left and right sides, stems or roots of plants can spread in the upper and lower directions as well as the left and right directions through the spaces, so that plants can naturally grow. The buried state of the blocks becomes more stable by the stems and roots of plants growing in the above manner.

In addition, water plants capable of purifying water may be planted in the portion submerged under water for thereby effectively purifying water. Since the blocks are formed of waste plastics, the resource is saved, and the fabrication cost is low. Economical fabrication is achieved.

INDUSTRIAL APPLICABILITY

As described above, in the embankment blocks of the present invention, the base frame forms a connection member in each rim, and a connection part on the front end of the connection member. The structure of the embankment blocks is hard and stable and light. Therefore, the fabrication, transfer and engaging work are easily performed. The fabrication cost is decreased, and the work efficiency is enhanced. The connection constructions of the embankment blocks are variously achieved. Therefore, the present invention may be well adapted to a corresponding bank or a slanted surface of road.

The present invention is not limited to the above embodiment. As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. An embankment block comprising:

a base frame comprising a rim including a plurality of holes and a center through hole enclosed by the rim, wherein the plurality of holes and the center through hole are separated by a plurality of partition plates;

a plurality of connection members that are downwardly and outwardly extended from outer surfaces of the rim of the base frame, wherein each of the connection members is extended off from a first plane defined by the base frame;

a plurality of outwardly bent connection parts, each of which is fixed at an end of each of the plurality of the connection members, wherein each of the connection parts are disposed substantially in parallel to and off from the first plane defined by the base frame;

a plurality of connection holes provided vertically to the first plane through the connection parts;

a plurality of engaging protrusions provided in at least some of the connection parts;

a plurality of engaging holes configured to engage with engaging protrusions of a neighboring block; and a plurality of guide parts, two of which are extended toward the base frame from each connection part so as to guide a connection part of a neighboring block, wherein each of the connection parts is configured to be connected in a horizontal direction aligning the base frames in one plane using the connection holes and the guide parts of neighboring embankment blocks or overlapped and connected in tier structure aligning the base frames in two parallel planes using the connection holes, the engaging protrusions, and the engaging holes of the neighboring embankment blocks.

2. The block of claim 1, wherein at least one connection member is outwardly widened in the outer side direction of the rim of the base frame.

3. The block of claim 1, further comprising a reinforcing rib formed in a longitudinal direction in an inner surface of at least on said connection member.

4. The block of claim 1, wherein at least one said connection hole is configured to connect with neighboring blocks.

5. The block of claim 4, wherein each said guide part is formed at a rear end of each said connection part for thereby guiding the front end of the connection part in such a manner that it is overlapped with a connection part of a neighboring embankment block, and wherein the front end of each said connection narrow width relative to the rear end.

6. The block of claim 1, wherein at least one engaging protrusion is formed in lower surface of at least one said connection part, and wherein at least one said engaging hole is formed in a lower surface of the at least one connection part and capable of receiving at least one engaging protrusion of a neighboring embankment block.

* * * * *